US006988462B1

(12) United States Patent
Zhu

(10) Patent No.: US 6,988,462 B1
(45) Date of Patent: Jan. 24, 2006

(54) MEMORY ASSIST DEVICE WITH CLIPS

(76) Inventor: Meijun Zhu, 2500 Lauriston Dr., Norman, OK (US) 73072

( * ) Notice: Subject to any disclaimer, the term of this patent is extended or adjusted under 35 U.S.C. 154(b) by 0 days.

(21) Appl. No.: 10/977,051

(22) Filed: Oct. 29, 2004

(51) Int. Cl.
*G09F 9/00* (2006.01)
*G06C 1/00* (2006.01)
*E05B 19/00* (2006.01)

(52) U.S. Cl. ..... 116/306; 116/307; 434/189; 40/330

(58) Field of Classification Search ..... 116/306, 116/307, 321, 325, 200, DIG. 1; 434/189, 434/200, 203, 204, 207; 40/299.01, 330, 40/659, 660
See application file for complete search history.

(56) References Cited

U.S. PATENT DOCUMENTS

| | | | | | |
|---|---|---|---|---|---|
| 888,708 | A | * | 5/1908 | Henderson | 116/306 |
| 3,505,973 | A | * | 4/1970 | Baker | 116/325 |
| 3,633,287 | A | * | 1/1972 | Squires et al. | 434/189 |
| 4,241,943 | A | | 12/1980 | Malinovitz | |
| 4,258,491 | A | | 3/1981 | Ernst et al. | |
| 4,261,121 | A | * | 4/1981 | Coon | 40/332 |
| 4,881,758 | A | | 11/1989 | Ben-David | |
| 4,958,455 | A | | 9/1990 | Jacobsen | |
| 4,993,952 | A | * | 2/1991 | Yeh | 434/191 |
| 5,066,234 | A | * | 11/1991 | LeDesma | 434/205 |
| 5,167,505 | A | * | 12/1992 | Walsh | 434/205 |
| 5,190,319 | A | | 3/1993 | Sandler | |
| 5,382,165 | A | * | 1/1995 | Knox | 434/127 |
| 5,395,245 | A | * | 3/1995 | Heinz | 434/204 |
| D407,338 | S | | 3/1999 | Kline | |
| D450,446 | S | | 11/2001 | Morrone | |
| 6,400,358 | B1 | | 6/2002 | Carter | |

* cited by examiner

*Primary Examiner*—R. Alexander Smith
(74) *Attorney, Agent, or Firm*—Martin A. Weeks

(57) ABSTRACT

The invention is for a memory assist device with an indicia field to indicate a number. The memory assist device includes at least two filaments extending between internal walls of the memory assist device to form an indicia field. The memory assist device also includes clips selectively clamped on the filaments to indicate the number. In one embodiment, the memory assist device has a loop portion for attachment to a key chain when using the memory assist device to indicate a floor on which a user has parked his car in a parking garage. In other embodiments, the memory assist device has a first numerical label to associate a numerical expression with a particular clip. In still other embodiments, the memory assist device has a second numerical label to indicate the position of the clips within the indicia field.

19 Claims, 7 Drawing Sheets

MEMORY ASSIST DEVICE WITH CLIPS

CROSS-REFERENCE TO RELATED APPLICATIONS

Not Applicable.

BACKGROUND OF THE INVENTION

1. Field of the Invention

The invention relates generally to memory assist devices for indicating numbers and more specifically to devices that indicate a floor number for a parking garage.

2. Description of the Related Art

Devices that assist a person to remember a particular number have been very common for many years. The most common way to remember a number is simply to write the number on a piece of paper. Quite often, however, a person may not have a writing instrument or a piece of paper available to write on. Furthermore, the person may not wish to carry pieces of paper with them and, when they do, they may forget to use them.

At the end of a work day, people that park their cars in parking garages often forget where they parked their cars in the morning. As parking garages become more common for large cities and universities and as the working population becomes older, the occurrence of forgetting where a person parked his or her car has become an increasing problem. While there have been other devices directed to solving this problem, these devices have been complex and expensive to manufacture and difficult to use.

Thus, there remains a need for a memory assist device that is simple to operate, simple to manufacture, always at hand when driving a car and is versatile in its application.

SUMMARY OF THE INVENTION

The invention is for a memory assist device with an indicia field to indicate a number. The memory assist device includes at least two filaments extending between internal walls of the memory assist device to form an indicia field. The memory assist device also includes clips selectively clamped on the filaments to indicate the number.

In one embodiment, the memory assist device has a loop portion for attachment to a key chain when using the memory assist device to indicate a floor on which a user has parked his car in a parking garage. In another embodiment, the indicia field of the memory assist device is formed in a key. In yet other embodiments, the memory assist device has a first numerical label to associate a numerical expression with a particular clip. In still other embodiments, the memory assist device has a second numerical label to indicate the position of the clip within the indicia field.

DETAILED DESCRIPTION

Figure 1:
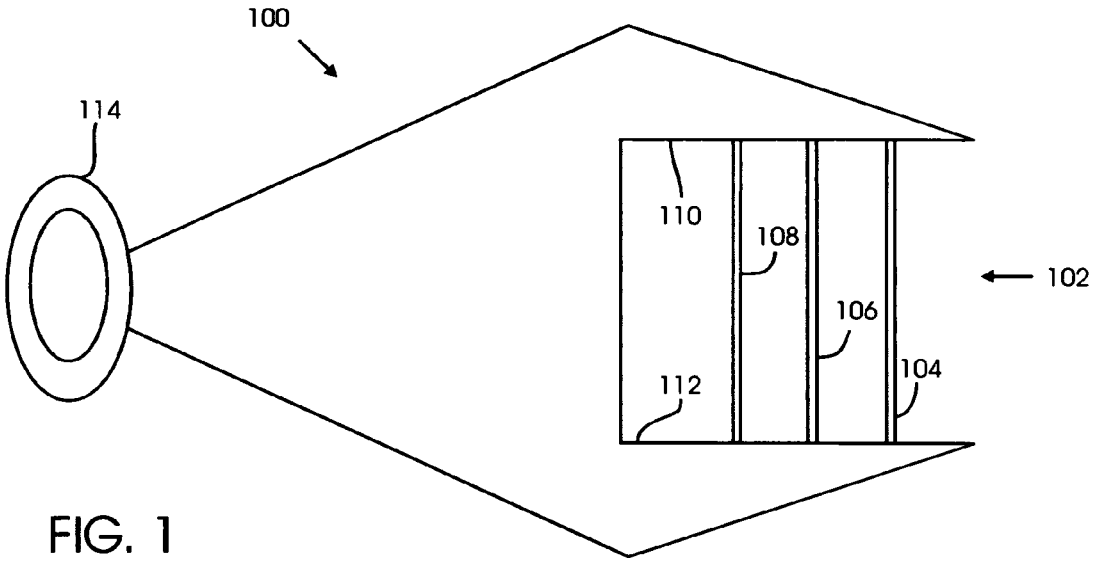
FIG. 1 is a top view of a memory assist device constructed in accordance with the present invention.

Referring to the drawings in general, and more particularly to FIG. 1, shown therein is a portion of a memory assist device 100 with indicia field 102. The indicia field 102 comprises a first filament 104, a second filament 106 and a third filament 108 that extend between internal walls 110, 112 of the memory assist device 100. The memory assist device 100 has a loop portion 114 for attaching the memory assist device 100 to a key chain.

Figure 2:
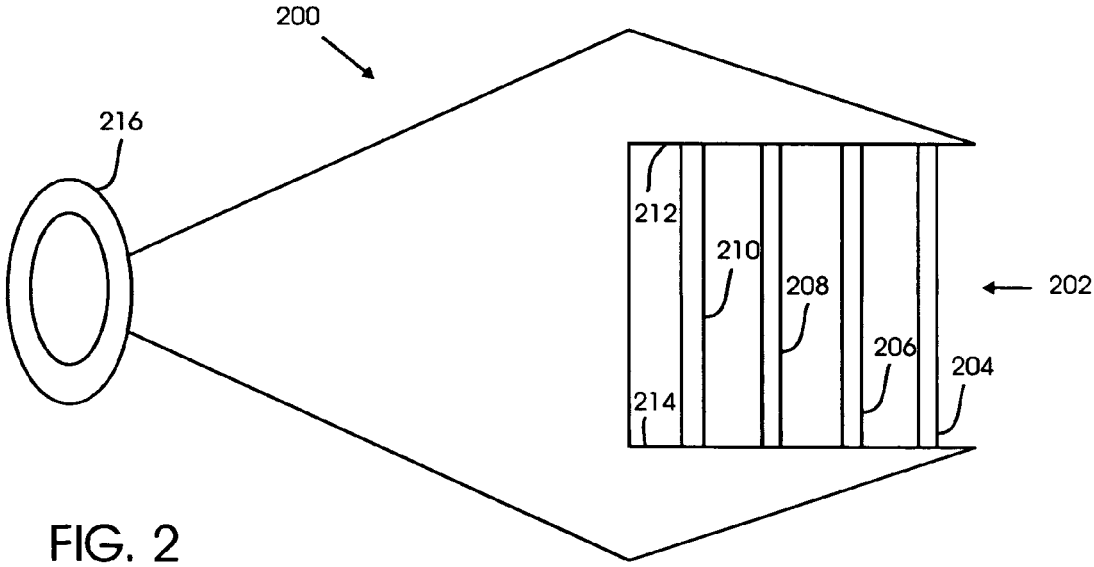
FIG. 2 is a top view of a memory assist device constructed in accordance with the present invention.

FIG. 2 shows a second memory assist device 200 with an indicia field 202. The indicia field 202 comprises a first rod 204, a second rod 206, a third rod 208, and a fourth rod 210 that extend between internal walls 212, 214 of the memory assist device 200. The memory assist device 200 has a loop portion 216 for attaching the memory assist device 200 to a key chain.

Figure 3:
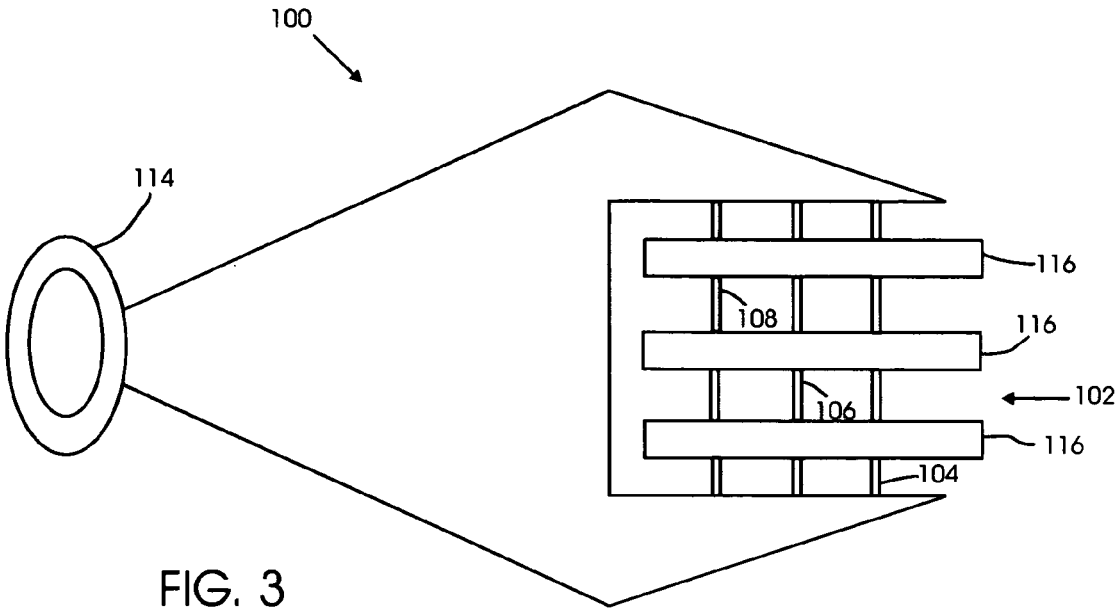
FIG. 3 is a top view of the memory assist device of FIG. 1 with clips positioned on an indicia field of the memory assist device.

FIG. 3 shows the memory assist device of FIG. 1 with three clips 116 positioned on the three filaments 102, 104 and 106. As will be discussed in more detail below, the clips 116 may be attached to one of the filaments, to two of the filaments, or to all three filaments to indicate a number. When one of the clips 116 is attached to only one of the filaments, the clip 116 is free to rotate about the filament to which it attached. When one of the clips 116 is attached to at least two of the filaments, the clip 116 is restrained from rotation about the filaments. As shown in FIG. 3, the clips 116 are attached to all three of the filaments 104, 106 and 108.

Figure 4:
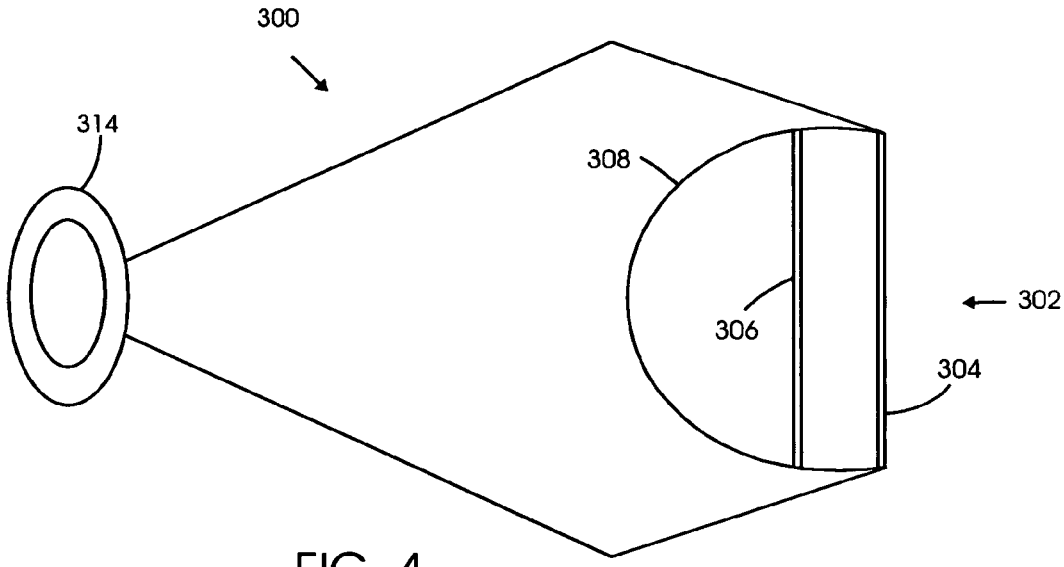
FIG. 4 is a top view of a memory assist device constructed in accordance with the present invention.

FIG. 4 shows a memory assist device 300 with an indicia field 302. The indicia field 302 comprises two filaments 304 and 306 that extend across a space defined between a curved internal wall 308 of the memory assist device 300. The memory assist device 300 has a loop portion 316 for attaching the memory assist device 300 to a key chain.

FIGS. 5–12 show the indicia field 102 of memory device 100 shown in FIGS. 1 and 3. For this embodiment of the invention, any of the three clips 116 are placed on either: (1) the first filament 104 and second filament 106, or (2) the first filament 104, the second filament 106 and the third filament 108. Thus, there are a possible eight position combinations for the clips.

Figure 5:
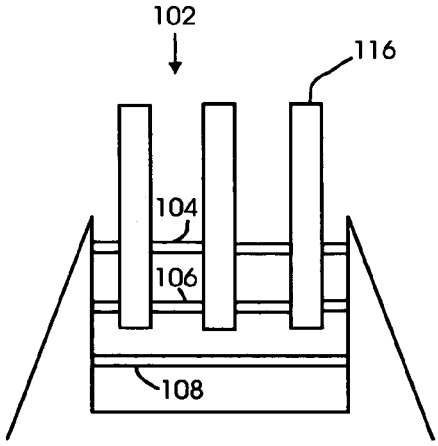
FIG. 5 is a top view of an indicia field with clips to indicate a number constructed in accordance with the present invention.
Figure 6:
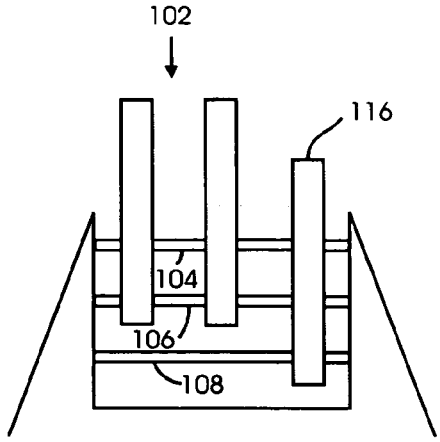
FIG. 6 is a top view of an indicia field with clips to indicate a number constructed in accordance with the present invention.
Figure 7:
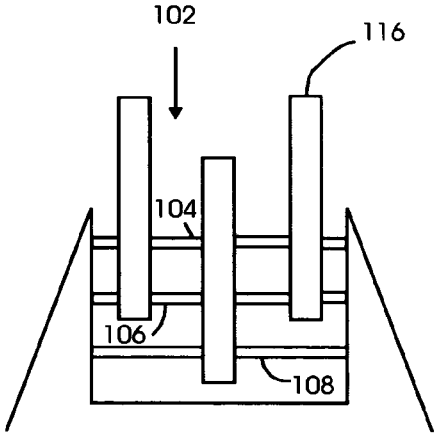
FIG. 7 is a top view of an indicia field with clips to indicate a number constructed in accordance with the present invention.
Figure 8:
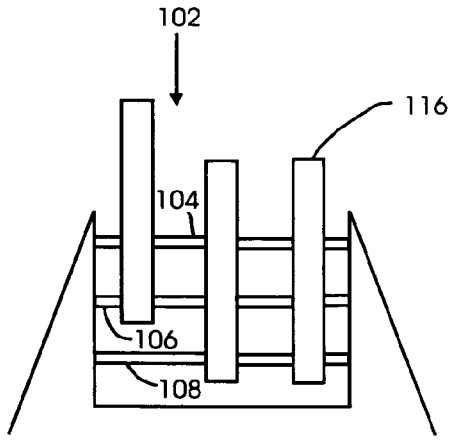
FIG. 8 is a top view of an indicia field with clips to indicate a number constructed in accordance with the present invention.
Figure 9:
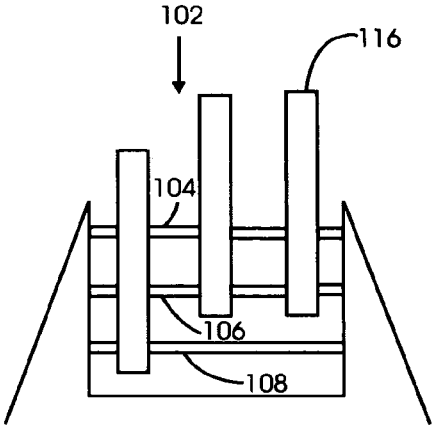
FIG. 9 is a top view of an indicia field with clips to indicate a number constructed in accordance with the present invention.
Figure 10:
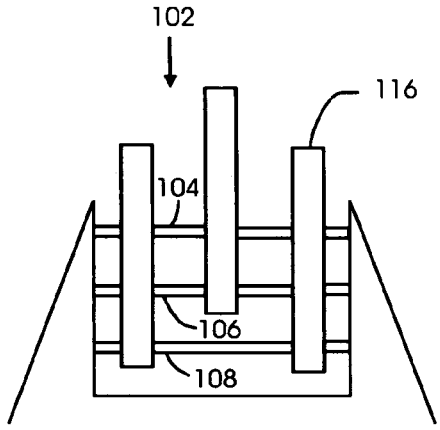
FIG. 10 is a top view of an indicia field with clips to indicate a number constructed in accordance with the present invention.
Figure 11:
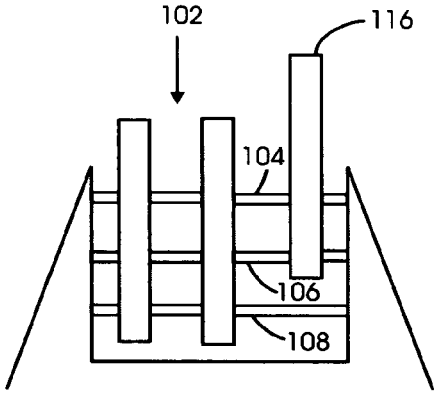
FIG. 11 is a top view of an indicia field with clips to indicate a number constructed in accordance with the present invention.
Figure 12:
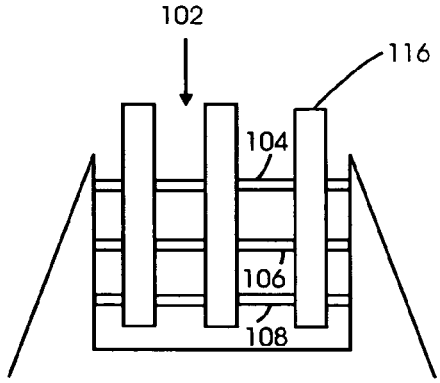
FIG. 12 is a top view of an indicia field with clips to indicate a number constructed in accordance with the present invention.

The clips 116 shown in FIG. 5 are in a first position combination. The clips 116 shown in FIG. 6 are shown in a second position combination. The clips 116 shown in FIG. 7 are in a third position combination. The clips 116 shown in FIG. 8 are in a fourth position combination. The clips 116 shown in FIG. 9 are in a fifth position combination. The clips 116 shown in FIG. 10 are in a sixth position combination. The clips 116 shown in FIG. 11 are in a seventh position combination. The clips 116 shown in FIG. 12 are in an eighth position combination.

Figure 13:
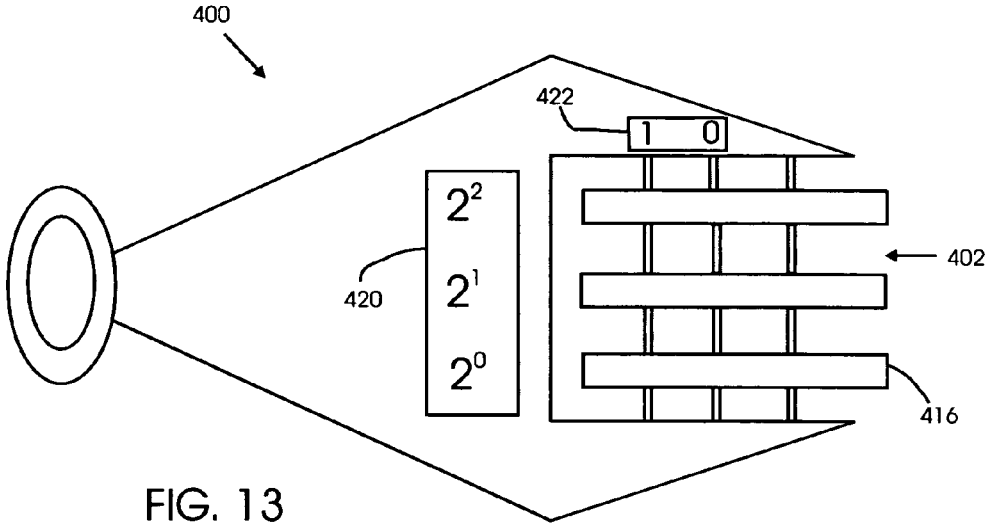
FIG. 13 is a top view of a memory assist device constructed in accordance with the present invention.
Figure 14:
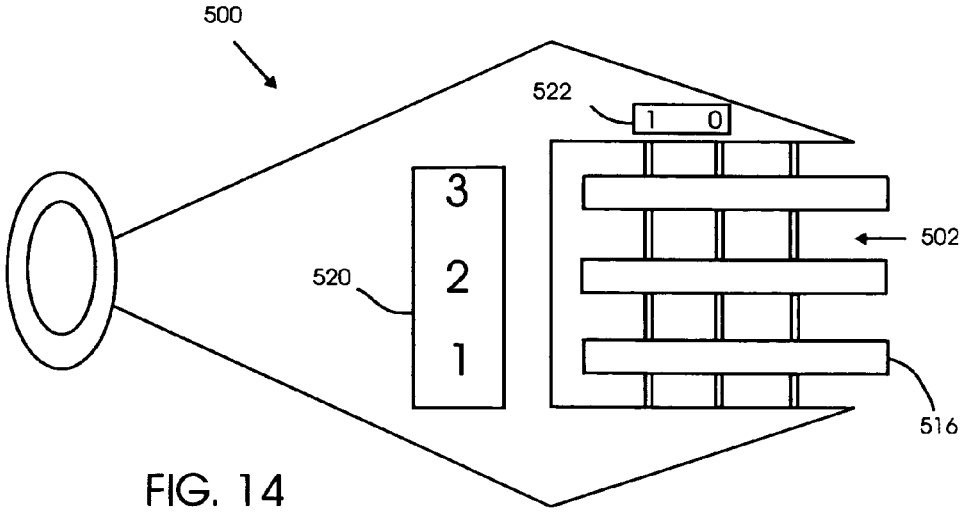
FIG. 14 is a top view of a memory assist device constructed in accordance with the present invention.

The different position combinations shown in FIGS. 5–12 may be converted to a number by at least 2 types of systems, as illustrated by considering the numerical labels in FIGS. 13 and 14. FIG. 13 shows a memory assist device 400 with first numerical label 420 and second numerical label 422. The first numerical label 420 aligns with each of the three clips 416. The first numerical label 420 has the numerical expressions "$2^0$," "$2^1$," and "$2^2$," which those skilled in mathematics easily recognize to be equal to values of 1, 2 and 4.

At the top of the memory assist device 400 shown in FIG. 13, the second numerical label 422 has the integers 0 and 1. For the configuration shown in FIG. 13, the clips 416 are positioned at position "111" in the indicia field 402, which corresponds to the eighth position combination shown in FIG. 12. The "111" position denotes the number $1*(2^0)+1*(2^1)+1*(2^2)$ which indicates the number 7. A full list of values corresponding to the eight position combinations shown in FIGS. 5–12 are shown below in Table 1.

For this embodiment with the first numerical label 420 has the numerical expressions "$2^0$," "$2^1$", and "$2^2$" the memory device 400 may also be a novelty learning item to teach young people to easily recognize Boolean numbers. Because of the widespread use of Boolean numbers in computer programming, the quick recognition of a Boolean number and its equivalent in the decimal system is an important mathematical skill for young people to learn.

For a second system of denoting a number of a parking garage floor, FIG. 14 shows a memory assist device 500 with a first numerical label 520 having the clip numerals 1, 2 and 3. Under this second system, the positions of the clips 516 are denoted as integers 0 or 1, as shown by the second numerical label 522. The integers 0 or 1 corresponding to a particular clip position is then multiplied by the clip numerals 1, 2 or 3 and then added together to find the number that denotes the parking garage floor on which the user's car is parked. For the positions of the clips 516 shown in FIG. 14, the number indicated is $1*(1)+1*(2)+1*(3)=6$. The position of the clips 516 on the indicia field 502 corresponds to the eighth combination shown in FIG. 12. Table 1 presents a list of the numbers indicated by the clip positions shown in FIGS. 5–12 for the second system of denoting numbers.

The two systems for indicating numbers using the clips and indicia fields are just two of the possible systems for denoting a parking garage floor. For example, for a system similar to the first system, four clips could be used and the numerical label 420 would have a numeral expression $2^3$ on the numerical label. Such a system would then have 16 combinations of positions for the clips. It is easily seen that the numbers of filaments could also be increased to also increase the number of possible combinations of clip positions for the indicia field. Other systems of indicating numbers using clips and indicia fields may also include complete removal of clips from the indicia field.

Furthermore, although the memory assist devices 400 and 500 are shown with labels, the memory assist devices may have no labels, as shown in FIGS. 1–12, but simply have instructions for how to use the memory assist device.

For some embodiments, the clips 416 and 516 may be of different colors to help the user more quickly recognize and differentiate the clip positions in the indicia field. In yet other embodiments, the clip numerals shown on the first numerical labels 420 and 520 may be positioned directly on the clips 416 and 516. The numerical labels 420, 422, 520 and 522 may be in the form of a decal attached to the memory assist devices 400 and 500 or may be integrally formed with the memory assist devices 400 and 500, such as in plastic molds used to make the clips.

Figure 15:
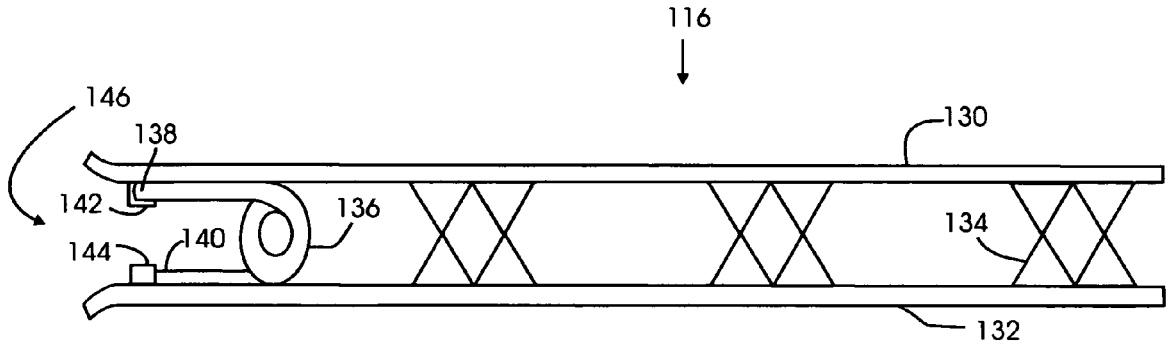
FIG. 15 is a side view of a clip constructed in accordance with the present invention.
Figure 16:
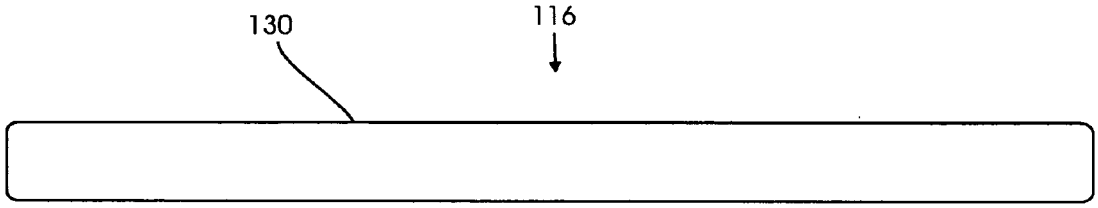
FIG. 16 is a top view of a clip constructed in accordance with the present invention.
Figure 17:
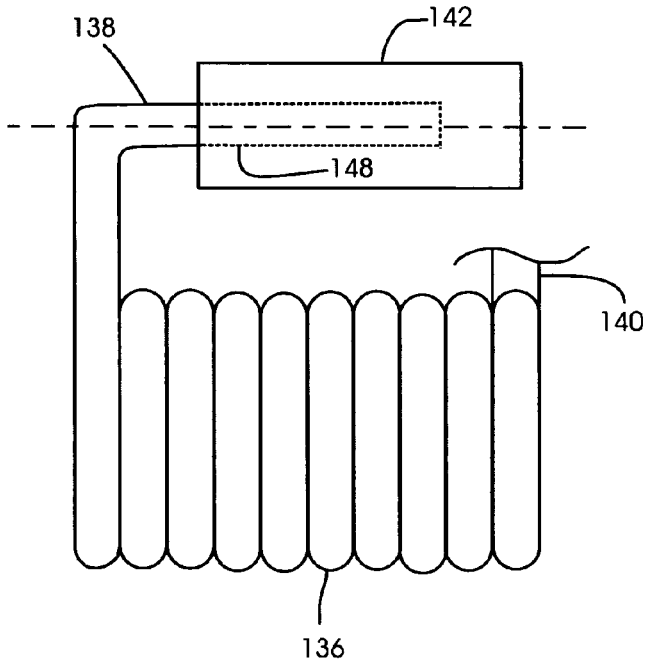
FIG. 17 is a partial, detailed schematic of a torsion spring of a clip constructed in accordance with the present invention.

FIGS. 15–17 show how the clip 116 is constructed. The clip 116 has an upper member 130 and an identically formed lower member 132, with teeth 134 attached to each of the upper member 130 and lower member 132. The teeth 134 are spaced to receive the filaments 104, 106 and 108 of the indicia field 102. In one embodiment, the teeth 134 fit snugly about the filaments 104, 106, and 108.

The upper member 130 and the lower member 132 are connected to a torsion spring 136 having an upper spring end 138 and a lower spring end 140. The upper spring end 138 fits into an upper spring mount 142 and the lower spring end 140 fits into a lower spring mount 144. One end 146 of the clip 116 has a slightly curved upper member 130 and lower member 132 to facilitate a user moving the clip 116 to an unclamped position.

The torsion spring 136 is dimensioned and arranged so that the torsion spring 136 normally biases the upper member 130 against the lower member 132. As schematically shown in FIG. 17, the upper spring end 138 fits into a slot 146 on the upper spring mount 142. Similarly, the lower spring end 140 fits into a slot (not shown) on the lower spring mount 144. In FIG. 17, the upper member 130 and the lower member 132 have been omitted for clarity in illustrating how the upper spring end 138 and the lower spring end 140 fit into the upper spring mount 142 and the lower spring mount 144.

To move the clip 116 from the clamped position to the unclamped position, a user squeezes the upper member 130 towards the lower member 132 at the clip end 146. While in the unclamped position, the user can move the clip 116 to the position in an indicia field to indicate the desired number, as described above.

Figure 18:
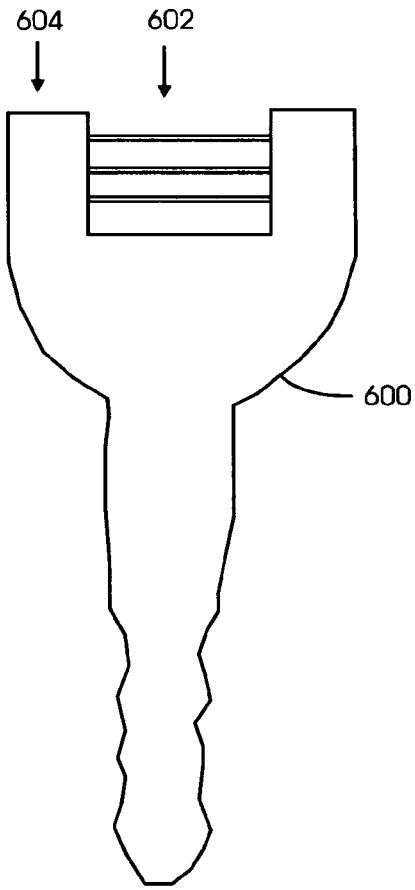
FIG. 18 is a top view of a memory assist device incorporated into a key constructed in accordance with the present invention.
Figure 19:
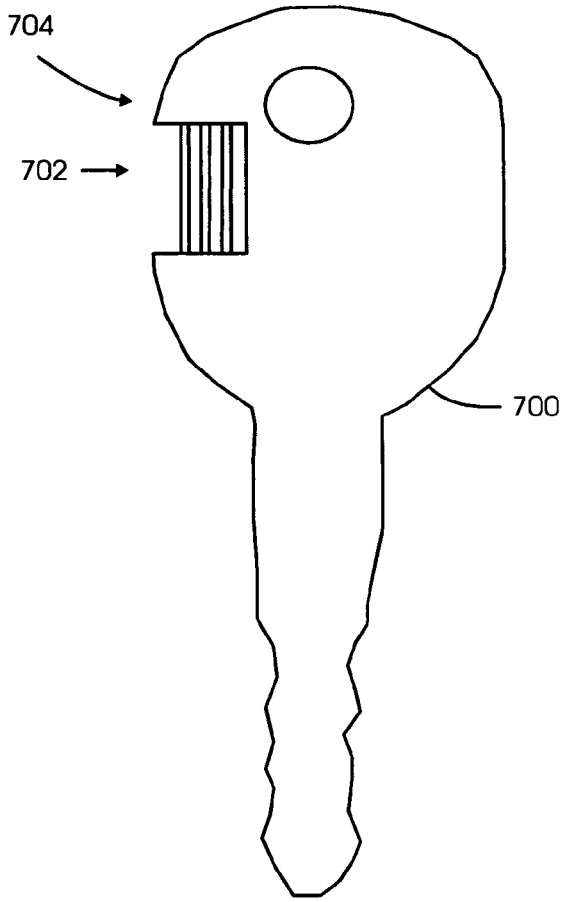
FIG. 19 is a top view of a memory assist device incorporated into a key constructed in accordance with the present invention.

FIGS. 18 and 19 show two embodiments of memory assist devices 600 and 700 where the indicia fields 602 and 702 are built into a key. For the memory assist device 600, the indicia field 602 is located at an end 604 of the key. For the memory assist device 700, the indicia field 702 is located at side 704 of the key. A clip, such as the clip 116 shown in FIGS. 15–17, is used to indicate a number in accordance with the systems described above.

While the term "memory assist device" has been used herein, it is to be understood that the memory assist device may equivalently be called a memory assist mechanism, a reminder device, or a memory assist instrument.

While the term "indicia field" has been used herein, the term "indicia field" may equivalently be called an indicia, a grid or a table.

While the term "filament" has been used herein, the term "filament" may equivalently be called a strand, a thread, a rod, or a pole.

The memory assist device and any of its components may be constructed of any suitable material, such as plastic material, metallic materials or a polymeric material.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

TABLE 1

| Clip Position | FIG. NUMBER | Number Indicated First System (Boolean) | Number Indicated Second System (123) |
|---|---|---|---|
| 000 | 5 | 0 | 0 |
| 100 | 6 | 1 | 1 |
| 010 | 7 | 2 | 2 |
| 110 | 8 | 3 | 3 |
| 001 | 9 | 4 | 3 |
| 101 | 10 | 5 | 4 |
| 011 | 11 | 6 | 5 |
| 111 | 12 | 7 | 6 |

What is claimed is:

1. A memory assist device with an indicia field to indicate a number, the memory assist device comprising:

(a) at least two filaments extending between internal walls of the memory assist device to form the indicia field; and (b) clips selectively clamped on the filaments to indicate the number, wherein each of the clips comprises:

(b1) an upper member having at least two sets of upper teeth;

(b2) a lower member having at least two sets of lower teeth, wherein each set of upper teeth contacts a set of lower teeth when the clamp is in a clamped position such that at least one set of lower teeth and the set of upper teeth which the lower set of teeth clamps onto at least one of the filaments; and (b3) a torsion spring attached to spring mounts on the lower member and the upper member, wherein the torsion spring biases the upper teeth against the lower teeth when the clamp is in the clamped position and wherein moving ends of the upper member toward ends of the lower member causes the clamp to move from the clamped position to an unclamped position.

2. The memory assist device of claim 1 further comprising a loop portion for connection to a key chain, wherein the number indicated by the memory assist device indicates a number associated with a floor of a parking garage.

3. The memory assist device of claim 2 wherein the indicia field is located on a key, wherein the number indicated by the memory assist device indicates a number associated with a floor of a parking garage.

4. The memory assist device of claim 1 wherein the number of clips is three.

5. The memory assist device of claim 4 further comprising a first numerical label corresponding to each clip, the first numerical label having the numerical expressions $2^0$, $2^1$, and $2^2$ written on the first numerical label, each numerical expression corresponding to a clip.

6. The memory assist device of claim 5 further comprising a second numerical label corresponding to a clip position within the indicia field, the second numerical label having integers 0 and 1 written on the second numerical label, wherein the number indicated by the clips and the indicia field is the sum for all the clips of the products of the numerical expressions on the first numerical label and the integers on the second numerical label that denote the clip position.

7. The memory assist device of claim 6 wherein the memory assist device is a novelty learning device for a user to learn how to quickly recognize Boolean numbers and the equivalent of the Boolean numbers in the decimal system.

8. The memory assist device of claim 4 further comprising a first numerical label corresponding to each clip, the first numerical label having the numerical expressions 1, 2, and 3 written on the first numerical label.

9. The memory assist device of claim 8 further comprising a second numerical label corresponding to a clip position within the indicia field, the second numerical label having integers 0 and 1 written on the second numerical label, wherein the number indicated by the clips and the indicia field is the sum for all the clips of the products of the numerical expressions on the first numerical label and the integers on the second numerical label that denote the clip position.

10. The memory assist device of claim 1 wherein the clips are of different colors to help a user more quickly recognize and differentiate the clip positions in the indicia field.

11. A method to indicate a number using a memory assist device, the method comprising:

(a) providing a memory assist device having an indicia field with filaments extending across a space defined in the memory assist device;

(b) providing clips that clamp onto the filaments in the indicia field; and (c) selectively positioning the clips on the filaments to indicate the number, comprising the substeps:

(c1) squeezing one end of a clip to move the clip to an unclamped position:

(c2) moving the clip to the desired position in the indicia field; and (c3) releasing the end of the clip to move the clip to a clamped position on the filaments.

12. The method of claim 11 wherein there are three clips.

13. The method of claim 12 further comprising the steps of:

(d) providing a first numerical label having the numerical expressions $2^0$, $2^1$, and $2^2$ written on the first numerical label, wherein the clips align with one of the numerical expressions $2^0$, $2^1$, and $2^2$;

(e) providing a second numerical label having integers 0 and 1 printed on the second numerical label, wherein the clips are positioned in the indicia field to align with either the integer 0 or 1 on the second numerical label;

(f) for a particular clip, obtaining the product of the numerical expression that aligns with the particular clip and the integer indicated by the position of the clip; and (g) summing the products obtained in step (f) for all the clips to obtain a number indicated by the memory assist device.

14. The method of claim 12 further comprising the steps of:

(d) providing a first numerical label having the numerical expressions 1, 2, and 3 written on the first numerical label, the clips aligning with one of the numerical expressions 1, 2, and 3;

(e) providing a second numerical label having integers 0 and 1 printed on the second numerical label, wherein the clips are positioned in the indicia field to align with either 0 or 1 on the second numerical label;

(f) for a particular clip, obtaining the product of the numerical expression that aligns with the particular clip and the integer indicated by the position of the clip; and (g) summing the products obtained in step (f) for all the clips to obtain a number indicated by the memory assist device.

15. The method of claim 11 wherein the memory assist device is attached to a key chain and wherein the memory assist device indicates a number associated with a floor of a parking garage on which a car is parked.

16. The method of claim 11 wherein the memory assist device is integrally formed in a key and wherein the memory assist device indicates a number associated with a floor of a parking garage on which a car is parked.

17. The method of claim 11 wherein the clips are of different colors to help a user to quickly recognize and differentiate clip positions in the indicia field.

18. A key with an indicia field to indicate a floor number of a parking garage, the key comprising:

(a) at least two filaments extending between internal walls of the key to form the indicia field; and (b) clips selectively clamped on the filaments to indicate the floor number of the parking garage.

19. A memory assist device with an indicia field to indicate a number, the memory assist device comprising:

(a) at least two filaments extending between internal walls of the memory assist device to form the indicia field;

(b) clips selectively clamped on the filaments to indicate the number; and (c) a loop portion for connection of the memory assist device to a key chain, wherein the number indicated by the memory assist device indicates a number associated with a floor of a parking garage.

* * * * *